US005403983A

United States Patent [19]

Luoma

[11] Patent Number: 5,403,983

[45] Date of Patent: Apr. 4, 1995

[54] ARC QUENCHING APPARATUS FOR CIRCUIT BREAKERS

[75] Inventor: Kari Luoma, Vaasa, Finland

[73] Assignee: ABB Strömberg Sähkönjakelu Oy, Vaasa, Finland

[21] Appl. No.: 133,132

[22] PCT Filed: May 4, 1992

[86] PCT No.: PCT/FI92/00139

§ 371 Date: Oct. 13, 1993

§ 102(e) Date: Oct. 13, 1993

[87] PCT Pub. No.: WO92/20083

PCT Pub. Date: Nov. 12, 1992

[30] Foreign Application Priority Data

May 6, 1991 [FI] Finland ..... 912178

[51] Int. Cl.[6] ..... H01H 33/10

[52] U.S. Cl. ..... 218/1; 218/81

[58] Field of Search ..... 200/144 R, 144 C, 146 R, 200/147 R, 147 A, 148 C, 148 H; 335/201

[56] References Cited

U.S. PATENT DOCUMENTS

| | | | |
|---|---|---|---|
| 4,511,772 | 4/1985 | Link et al. | 200/144 R |
| 4,521,653 | 6/1985 | Yoshiyasu et al. | 200/144 C |
| 4,629,840 | 12/1986 | Dirks et al. | 200/147 R |
| 4,650,938 | 3/1987 | Genba | 200/144 R |
| 4,654,490 | 3/1987 | Leone et al. | 200/147 R |

FOREIGN PATENT DOCUMENTS

| | | | |
|---|---|---|---|
| 0269750 | 6/1988 | European Pat. Off. | H01H 9/36 |
| 157242 | 9/1990 | European Pat. Off. | H01H 33/10 |
| 855773 | 8/1981 | U.S.S.R. | H01H 33/10 |

*Primary Examiner*—J. R. Scott

*Attorney, Agent, or Firm*—Watson, Cole, Grindle & Watson

[57] ABSTRACT

An arc quenching apparatus for circuit breakers includes a quenching space (10) in which each phase has a stationary contact (11) and a knife contact (12) pivotable in relation thereto, and which has a quenching chamber (13) in whose body member (15), made of an insulating material, quenching plates (14) are disposed in a spaced-apart relation so as to be located successively in relation to the path (P) of the opening movement of the knife contact (12). To overcome the problem of soot depositing in the quenching plate support structure made of an insulating material, which makes the support structure conductive between the quenching plates and adversely affecting the breaking capacity of the circuit breaker. Stop elements (20, 21*a*, 21*b*, 31, 42) are disposed between the ends of the quenching plates (14) on the knife contact (12) side and the body member (15). These stop elements prevent the generated arc(s), which is being extinguished, from directly contacting the body member (15) at least in the spaces (22) between the quenching plates (14).

5 Claims, 4 Drawing Sheets

ARC QUENCHING APPARATUS FOR CIRCUIT BREAKERS

BACKGROUND OF THE INVENTION

The invention relates to an arc quenching apparatus for circuit breakers, based on a plate chamber construction. The apparatus comprises a quenching space in which each phase has a stationary contact and a knife contact pivotable in relation thereto, and which has a quenching chamber in whose body member, made of an insulating material, quenching plates are disposed in a spaced-apart relation so as to be located successively in relation to the path of the opening movement of the knife contact. The arc quenching installation according to the invention is particularly suitable for use in $SF_6$-insulated medium-voltage circuit breakers.

A basic construction of the kind described above is known, for instance, from the Applicant's earlier load circuit breaker of the type OETL 250 . . . 3150 (the FIGURES refer to ampere values), wherein the quenching plates are disposed in the form of a circular arc substantially perpendicularly to the tangent of the path of the knife contact.

Another extinguishing apparatus based on a plate chamber construction is known from European Patent 0 157 242. In this apparatus, a stationary contact and a quenching chamber are disposed on a busbar. The quenching plates of the quenching chamber are disposed in the chamber in parallel with the tangent of the starting point of the path of the knife contact and in a spaced-apart relation, and further superposed with an overlap so that the distance between the movable knife contact and the quenching plates increases as the opening movement of the knife contact proceeds.

The advantage with the quenching installations of the type described above, based on a plate chamber construction, is that the actual circuit breaking operation is successful with a small amount of energy. However, the problem with this apparatus has been found to be that the arc will produce a layer of soot on the quenching plate support structure made of an insulating material, and this soot layer will make the support structure conductive between the quenching plates. As a result, the breaking capacity of the circuit breaking apparatus is strongly impaired.

SUMMARY OF THE INVENTION

The purpose of the present invention is to remove this problem and to achieve an arc quenching apparatus by means of which the breaking capacity of a circuit breaker based on the plate chamber principle can be made considerably better than heretofore. This is achieved with the apparatus of the invention, which is characterized in that stop means are disposed between the ends of the quenching plates on the knife contact side and the body member, the stop means preventing direct contact with the body member at least in the spaces between the quenching plates.

The basic idea of the invention is to introduce between the ends of the quenching plates on the knife contact side and the support structure of the quenching plates (the body member of the quenching chamber), which is made of an insulating material, means preventing direct contact with the body member at least between the quenching plates, thus preventing the passage of the arc to the support structure or to the vicinity thereof. Such means can also be located over the topmost quenching plate and under the lowermost quenching plate.

The improved breaking capacity achieved on account of the invention means that the breaking will be successful with currents markedly higher than heretofore, or, correspondingly, that with the same current values a considerably higher number of breaking times than heretofore is achieved.

In accordance with two advantageous embodiments of the invention, the stop means are constituted by ridges or steps made in the quenching plates. Thus one avoids using separate barrier members, and the stop means are easy to manufacture for instance in connection with the die cutting of the quenching plates.

The invention will be explained in more detail in the following, with reference to examples according to the accompanying drawings.

DETAILED DESCRIPTION OF THE PREFERRED EMBODIMENTS

Figure 1A:
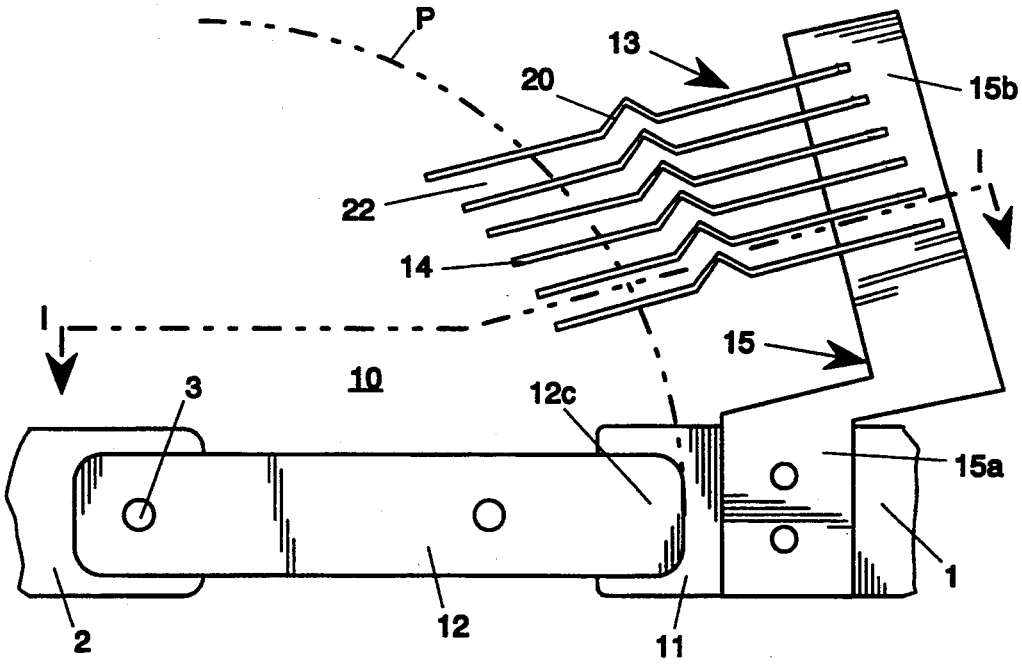
FIG. 1*a* is a side view of an apparatus according to a first embodiment of the invention.
Figure 1B:
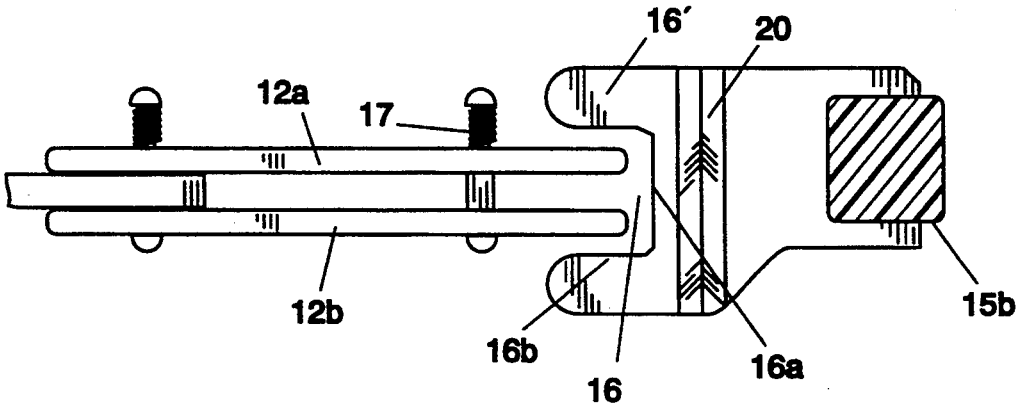
FIG. 1*b* is a view of an apparatus according to FIG. 1*a* taken along line I—I of FIG. 1*a* and without the topmost quenching plates.

FIGS. 1*a* and 1*b* show a quenching apparatus according to a first embodiment of the invention. In this apparatus, a circuit breaker is disposed in a quenching space 10 within a gas-tight box (not shown), the circuit breaker comprising a stationary contact 11 connected to a first element 1 of the current path, and a movable knife contact 12 connected to a second element 2 of the current path by pivoting it thereto by means of a fulcrum pin 3. The knife contact is guided by guide means known per se (not shown) between a closed position and an open position. In FIG. 1*a*, the knife contact has been shown in the closed position wherein its tip 12*c* touches the stationary contact 11. The knife contact comprises two parallel knives 12*a* and 12*b* (FIG. 1*b*) that are pressed against one another by means of springs 17 to produce an appropriate contact force on the contact surfaces. To improve the breaking capacity, the quenching space 10 is filled with an extinguishing and insulating medium in a manner known per se, such medium advantageously being sulphur hexafluoride ($SF_6$) or some mixture thereof.

A quenching chamber 13 is attached to the stationary contact 11, this chamber being composed of a body member 15 made of an insulating material, such as plastic, and quenching plates 14 supported thereto and being substantially parallel and spaced apart. In this exemplary case, there are six quenching plates of a material suitable for this purpose, such as coated (zinc coated) steel plates. The body member 15 of the quenching chamber comprises in accordance with the invention a lower portion 15*a* fixed to the stationary contact and a fixing shaft 15*b* extending obliquely upwards therefrom, to which shaft the quenching plates 14 are attached so that each quenching plate extends from its end facing the body member to both sides of the fixing shaft 15*b*.

As the circuit breaker opens, the tip of the knife contact travels a path having the form of a circular arc, which has been indicated with a broken line P. Grooves 16 (FIG. 1*b*) are formed in the ends of the quenching plates 14 on the knife contact side, and edge flanges 16' are formed in each quenching plate. The tip of the knife contact extends to the space constituted by the groove and travels in this space during its movement. The distance of the tip of the knife contact from the front edge 16*a* of the groove is approximately equal to its distance from the lateral edges 16*b* of the groove, and the successive plates 14 are disposed in relation to the path of the opening movement so that the distance of the tip of the knife contact from the quenching plates remains the same when the opening movement proceeds. By means of the grooves in the front edges of the quenching plates, the control of the arc can be improved. The use of the grooves for this purpose is known per se.

As the knife contact is detached from the stationary contact, an arc is immediately generated therebetween. As the opening movement proceeds, the arc is divided so that base points are generated therefor also in the quenching plates. In order to ensure that the arc will remain burning between the quenching plates 14 and cannot soot the body member 15, transverse ridges 20 are formed in the quenching plates, these ridges preventing direct contact with the body member 15 in the spaces 22 between the quenching plates. In order to prevent direct (optical) contact, the ridges have at least partly been arranged with an overlap, and the height of each ridge is at least equal to the distance between the plates. Besides that, the ridges prevent the passage of the arc to the vicinity of the body member 15, they also prevent the propagation of heat radiation to the body member.

Figure 2A:
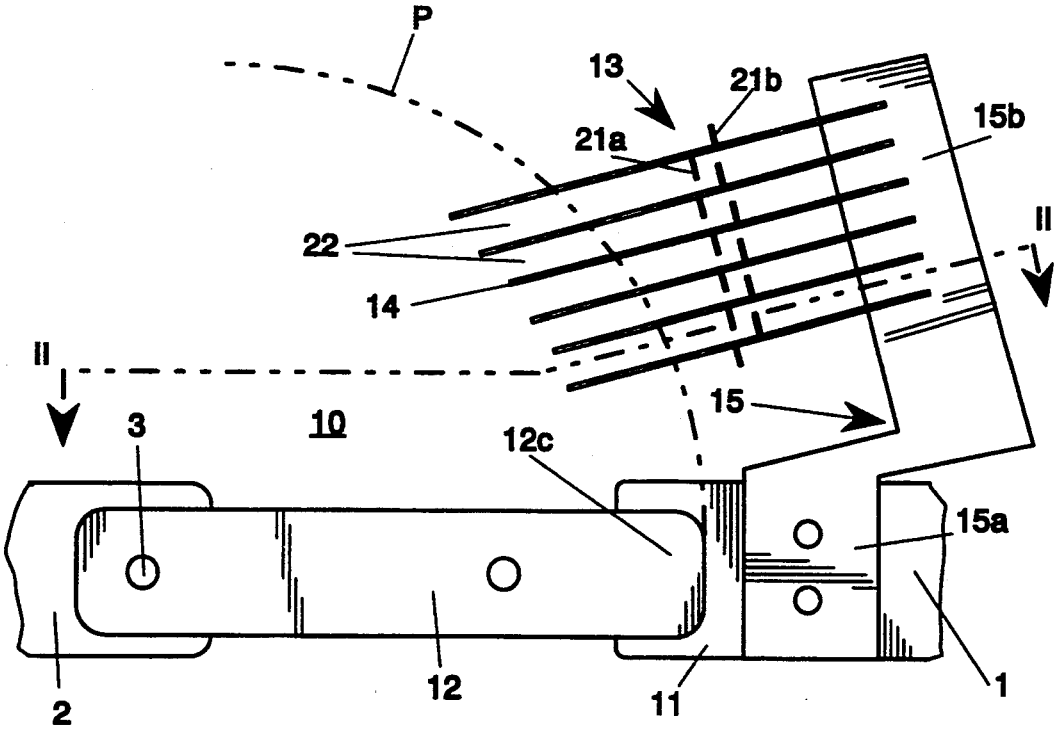
FIG. 2*a* is a side view of an apparatus according to another embodiment of the invention.
Figure 2B:
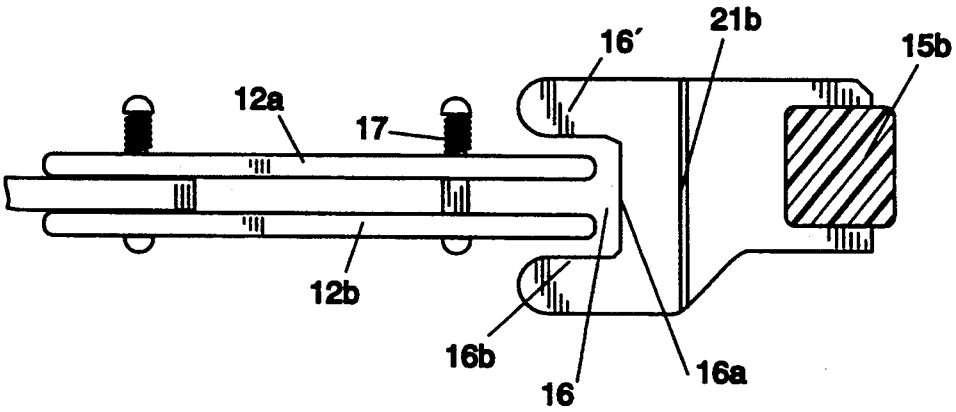
FIG. 2*b* is a view of an apparatus according to FIG. 2*a* taken along line II—II of FIG. 2*a* and without the topmost quenching plates.

An apparatus according to another embodiment of the invention has been shown in FIGS. 2*a* and 2*b*. In this case, the construction is otherwise the same but the ridges in the quenching plates have been replaced with transverse barrier plates 21*a* and 21*b*, which are disposed on the lower and upper surface of each quenching plate respectively. The barrier plates 21*a* and 21*b* on the upper and lower surfaces are displaced in the longitudinal direction of the quenching plate to different positions, and thus the barrier plates on the upper surface of the lower quenching plate and on the lower surface of the upper quenching plate together prevent direct contact with the body member 15 in each intermediate space 22. The height of the barrier plates in the same intermediate space is thus smaller than the distance between the quenching plates, but their total height is at least equal to the distance between the plates.

Figure 3A:
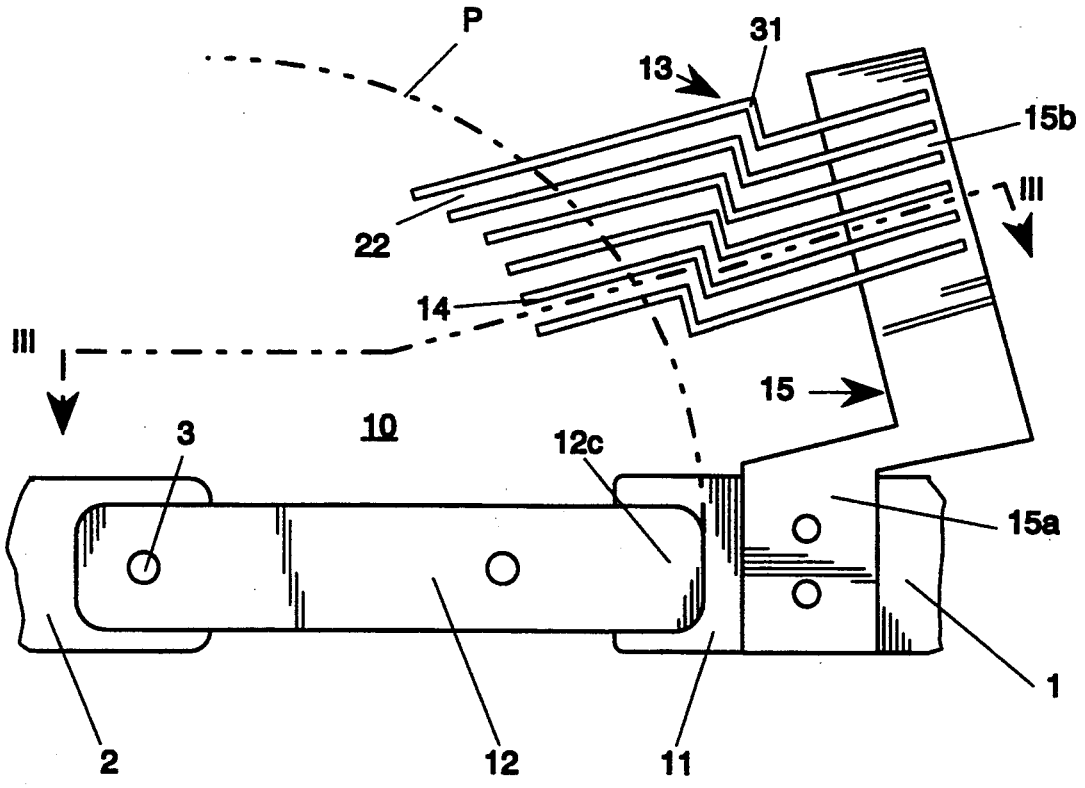
FIG. 3*a* is a side view of an apparatus according to a third embodiment of the invention.
Figure 3B:
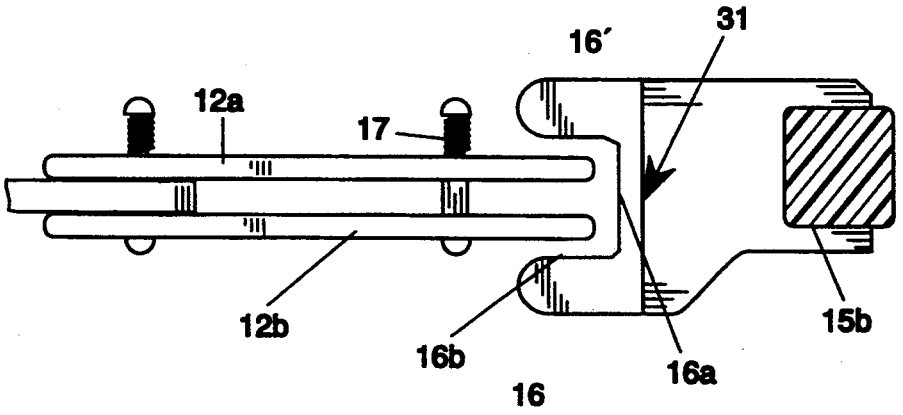
FIG. 3*b* is a view of an apparatus according to FIG. 3*a* taken along line III—III of FIG. 3*a* and without the topmost quenching plates.

FIGS. 3*a* and 3*b* show an apparatus according to a third embodiment of the invention. The construction is still the same, except that the ridges or barrier plates have in this case been replaced with steps 31 provided in the quenching plates, these steps being displaced in the longitudinal direction of the quenching plates to have an overlap. In order to prevent direct contact with the body member 15 in the intermediate space 22, the height of each step in this case is at least equal to the distance between the quenching plates.

Figure 4:
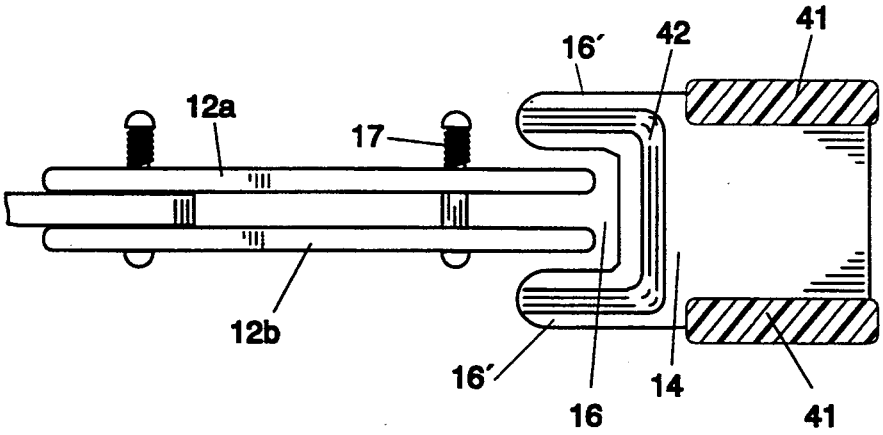
FIG. 4 is a top view of an quenching plate according to an alternative embodiment.

The ridges, barrier plates, steps or the like disclosed above need not necessarily extend directly in the transverse direction of the quenching plates as set forth hereinabove, but they can be shaped for instance in the manner shown in FIG. 4 so as to extend from the leading edge of one edge flange 16' around the groove 16 in the quenching plate to the leading edge of the opposing edge flange 16', and thus they also prevent the blowing of the arc to the sides of the quenching chamber, which might cause a disruptive discharge between the phases or to the earth. Also, since the stop means in this case give better protection in the lateral direction, the body member of the quenching chamber need not be located centrally. Thus in the example of FIG. 4, the body member is constituted in a known manner by separate side walls 41 between which the quenching plates are fixed. The stop means, which in this example have been shown as a ridge having the cross-section of a circular arc, are denoted by reference numeral 42. However, if additional protection is not needed on the sides of the quenching chamber, the attachment of the quenching plates in accordance with the examples of FIGS. 1*a*–3*b* to a body member constituted by a single piece only is advantageous in that it makes possible simpler (straight) stop means.

Even though the invention has been explained in the foregoing with reference to an example according to the accompanying drawing, it is obvious that the invention is not restricted thereto, but can be modified in many ways within the scope of the attached claims. For instance, the quenching plates need not be parallel, and all of them need not be disposed at the same distance from the tip of the knife contact. The shape and number of the ridges can vary in accordance with how the quenching plates are disposed in relation to one another: the ridges may, for instance, have the shape of a circular arc and be vertically aligned. The ridges can also replace the barrier plates in such a way that there is a ridge corresponding to a barrier plate on the upper and lower surface of each plate. The barrier plates can in principle also be replaced with a barrier net, but this is not as secure an arrangement as a barrier plate. However, the blocking of a direct contact with the body member is to be understood to encompass also arrangements based on barrier nets. Even though the arc quenching installation according to the invention is suitable for use particularly in connection with medium-voltage circuit breakers (in the voltage range 1 kV–about 36 kV), the same principle can also be applied in the low and high voltage ranges.

I claim:

1. An arc quenching apparatus for circuit breakers comprising a quenching space in which each phase has a stationary contact and a knife contact pivotable in relation thereto, and a quenching chamber including:

a body member made of an insulating material, at least part of said body member being in the form of a fixing shaft, quenching plates disposed in a spaced-apart relation in the quenching chamber, said quenching plates extending from said fixing shaft into a path of movement of the knife contact and attached to the fixing shaft so that each quenching plate extends from an end thereof facing the body member to both sides of the fixing shaft, and stop means integral with the quenching plates and disposed between the ends of the quenching plates on the knife contact side and the body member, said stop means preventing passage of the arc to the body member at least in the spaces between the quenching plates.

2. An arc quenching apparatus as claimed in claim 1, wherein the stop means consist of ridges formed along the quenching plate, the ridges being substantially straight in a transverse direction of the quenching plates.

3. An arc quenching apparatus as claimed in claim 1, wherein the stop means consist of steps formed by the quenching plates, the steps being substantially straight in a transverse direction of the quenching plates.

4. An arc quenching apparatus as claimed in claim 1, wherein the stop means consist of barrier plates fixed to the quenching plates, the barrier plates being substantially straight in the a transverse direction of the quenching plates.

5. An arc quenching apparatus for use with circuit breakers located within a quenching space, said circuit breakers including a stationary contact and a movable knife contact which is pivotally mounted such that a tip thereof can contact said stationary contact and move along a path of travel away from said stationary contact, said apparatus comprising:

a body member made of an insulating material and including a first portion attached to said stationary contact and a second portion extending away from said stationary contact and forming a fixing shaft, a plurality of spaced-apart quenching plates connected to said fixing shaft and extending from first ends which extend around opposite sides of said fixing shaft to opposite second ends which define grooves within which said tip of said movable knife contact extends as said tip moves in said path of travel away from said stationary contact, and stop means integral with said quenching plates and located between said first and second ends thereof for preventing electrical arcs from traveling between said tip of said knife contact and said body member in spaces between said quenching plates.

* * * * *